United States Patent [19]

Hammond

[11] Patent Number: 4,558,799

[45] Date of Patent: Dec. 17, 1985

[54] CONTAINER WITH HINGED LID

[75] Inventor: Clifton E. Hammond, Elkhorn, Nebr.

[73] Assignee: Snyder Industries, Inc., Lincoln, Nebr.

[21] Appl. No.: 469,258

[22] Filed: Feb. 24, 1983

[51] Int. Cl.[4] ..... B65D 43/14

[52] U.S. Cl. ..... 220/343; 220/263; 220/337; 220/1 T

[58] Field of Search ..... 220/343, 254, 263, 237, 220/1 T, 337

[56] References Cited

U.S. PATENT DOCUMENTS

| | | | |
|---|---|---|---|
| 1,550,043 | 8/1925 | Pearson | 220/334 |
| 1,837,916 | 12/1931 | Michelman . | |
| 2,529,248 | 11/1950 | Fleck | 220/263 |
| 2,582,540 | 1/1952 | Gruse | 49/367 |
| 3,373,892 | 3/1968 | Landen | 220/343 |
| 3,655,088 | 4/1972 | Box | 220/337 |
| 4,158,424 | 6/1979 | Carmack | 220/343 |
| 4,161,261 | 7/1979 | Frater | 220/343 X |
| 4,213,539 | 7/1980 | Reuter | 43/14 |

FOREIGN PATENT DOCUMENTS 2633533 of 1978 Fed. Rep. of Germany .

*Primary Examiner*—Steven M. Pollard
*Attorney, Agent, or Firm*—Banner, Birch, McKie & Beckett

[57] ABSTRACT

This invention relates to a large capacity, molded refuse container having a lid comprised of two identical, overlapping cover elements. The cover elements are each pivotally interconnected to the container by a hinge means which includes a hinge pin passing through an integral sleeve molded into the hinge. Portions of the hinge pin are exposed to allow the hinge pin to function as a handle.

12 Claims, 6 Drawing Figures

CONTAINER WITH HINGED LID

BACKGROUND OF THE INVENTION

1. Technical Field

The present invention relates generally to molded containers with hinged lids, and, more particularly, to a cover and hinge assembly for large capacity refuse containers.

2. Background Art

Containers of this type, particularly in larger sizes on the order of 300 gallons, are particularly well suited for commercial use in receiving refuse. These refuse containers are capable of being handled by automated equipment, such as a side-loading refuse truck having a retractable lifting clamp which grasps, lifts and inverts the container to empty its contents.

The use of large plastic refuse containers with hinged lids is common to many settings, especially commercial settings. Such containers usually have lids pivotally fastened to the body by hinges which are mechanically fastened to the body and the lid. In addition, handles are usally fastened to the lid to facilitate the raising of the lid when manual access to the interior of the container is desired.

Refuse collections in major cities are labor intensive and as a result tend to be a major item in a city's budget. In order to reduce costs, the refuse collection industry has evolved from the highly labor intensive manual handling of each container to semi-automatic systems where the container is manually moved to the side of the compactor truck, gripped either semi-automatically or manually by lifting arms and then, at the touch of a control, lifted, inverted, emptied, and returned to the ground. The container then is disconnected and manually returned to curb side. Even more recently, fully automated systems have been developed which allow the driver to rapidly position the truck adjacent to the container at curb side, automatically extend an arm, grip container, raise, invert, empty, and return the container to curb side. The operation requires no labor except for the truck driver/operator and it is considerably faster than semi-automatic or automatic systems. The faster (short cycle time) systems increase the utilization of the compacting truck, which, in turn, reduces the capital expenditure requirements to service a given size population.

Both semi-automatic and automatic refuse collection systems require special container designs to allow interface with the lifting mechanism. The semi-automatic systems, however, do not require unusual closure designs since there is a man present in the area of the lift to unlatch or to remove a cover as is appropriate. The automated systems, however, must be equipped with a cover that will normally be closed; easily opened by the user; automatically opened when the container is inverted; automatically closed when the container is returned to curb side; and, be strong enough to withstand the rough handling that is inherent with a high speed automated lifting and emptying mechanism.

Since the containers must be especially designed for automated systems, mosts cities find it necessary to provide containers to the users at no cost or at a nominal fee. Containers, therefore, can be a major part of a city's capital expenditure on a newly implemented automated refuse collection system. Cost, durability, and use acceptance are all factors that affect the design of a typical automated refuse container system.

In some instances, such as multi-family dwellings, or in other densely populated areas it may be more efficient to use a larger container capable of filling the needs of two or more families. Such a container typically has a capacity of 300 to 400 gallons. These containers must be collected automatically with the same system as is used in the smaller single family dwelling containers. Therefore, the height of the container is restricted which in turn requires a relatively large top diameter. A typical top diameter for a large capacity refuse container would be 50–60 inches. A single cover large enough to close a top opening of this size with hinges located on the outer edge of the container has several drawbacks. Covers of a 50–60 inch diameter tend to be flexible and distort when lifted from one side by the user to insert refuse. Large covers tend to be structurally unstable and when they are closed abruptly or when a load is applied to the top of a cover it tends to distort and slip inside the container. Large covers tend to remain open after the container has been returned to curb side by an automated compactor since a large force is required to close the cover. Large covers that do remain open tend to move the center of gravity of the container and cause it to roll over when the container has been returned to curb side. Large covers tend to be heavy and, as a result, the hinge areas routinely tear out or fail in one manner or another. Large covers are subject to being opened by high winds, or, if opened partially by a user, the wind tends to catch the cover and upset the container. Finally, there is a tendency for the very large cover to be caught by the compactor blade or other structural members of the compactor truck.

Attempted solutions to the problems caused by a single, large, heavy cover for a large capacity refuse container have been to create multi-fold covers. Such a cover might have a hinge near the periphery that would be used when the container is being emptied, and a second hinge somewhere in the middle to allow the user to lift only a part of the cover to insert refuse. These containers are even less stable than full cover containers and there are inevitable structural failures as well as problems of the cover falling down into the container. Another attempted solution that has been tried is the use of a large cover hinged at the periphery and a smaller opening integral with the cover with a separate smaller cover that will be used by the resident for filling. These, however, have problems similar to those discussed above.

Additionally, all of the prior art large capacity refuse containers have problems with water infiltrating into the refuse container.

In the prior art, holes have conventionally been drilled to allow the hinge rod to pass through the hinge portions on the cover element and the container body. These drilled holes create high stress concentration areas in the body and the cover. It also creates a high bearing load on the hinge pin since the load is concentrated in the narrow areas of wall thickness in contact with the hinge pin. The present invention eliminates this problem by the use of an integral sleeve formed in the container body hinge portion.

The manufacture of prior art containers of the above-described type requires that extensive post-molding operations be carried out to mount the appropriate hardware on the container. For instance, to fasten the hinges, holes must be drilled in the body and lid. The hinges are then secured to the container by means of screws or other mechanical fasteners. To fasten the handles, holes must again be drilled and the handles then secured by means of screws.

The requirement of extensive post-molding assembly poses serious problems. First, it requires many separately manufactured parts. This large number of parts and the increased production time and labor required to assemble them increases cost and slows down production. Finally, the addition of so many parts weakens the container because of additional boring and the tendency of wear and fatigue of the material at mechanical connections. Thus, the finished product is less durable.

A strong need therefore exists for a container with a hinged lid that requires few additional parts and little assembly.

SUMMARY OF THE INVENTION

The present invention overcomes the problems of the prior art by providing a container body with a lid composed of two identical, overlapping cover elements adapted to overlie the open end of the container body. The cover elements are each hinged on their outer periphery to opposite sides of the container body. Each of the cover elements extends from the outer periphery of the container body, where it is hinged, to a point beyond the centerline of the container body. Thus, when the cover elements are closed, one of the cover elements will overlap the other. Since each of the cover elements is identical in size and structure, it is immaterial which of the cover elements is closed first. As will be explained more fully below, the feature provides important advantages when the container is used in a fully automated refused collected system. The two-part lid also provides other advantages. The portion that must be lifted is approximately half of the weight of a full cover. Additionally, the mechanical advantage from the lifting point is substantially improved so that even young children and older residents can open either half of the lid with considerably less effect than prior art designs. Since each half of the lid is relatively short and has approximately half of the cross sectional area of a single lid, the problems of the wind opening the cover or tipping the container over are virtually eliminated. Damage to the lid as a result of the lid being trapped by the compactor blades is greatly reduced, and the structural rigidity is increased to prevent the lid from being distorted and slipping into the container.

In the preferred embodiment, the lid, composed of the two cover elements, is dome-shaped to add structural rigidity, to allow water to run-off the lid, and to add a few cubic feet of usable space inside the container. Each of the cover elements may contain a barrier or rib adjacent the overlapping portion of the cover elements. The rib serves several purposes. The first purpose is as a structural reinforcement to help the cover retain its shape. The second purpose is to create a water barrier so that water will not seep under the overlapped cover elements. A third purpose is to create a wind barrier that prevents the wind from lifting the opposite cover.

The zone between the rib and the center edge of the cover is a potential water shed area and rain that falls directly in this zone might infiltrate the container. Accordingly, the inner edge of the cover element is turned up slightly to form a channel to direct the water off the container.

Each of the cover elements is pivotally interconnected by a hinge to the outer periphery of the container body. The two-part lid permits use of an integral hinge; a single large lid would tend to be unwieldly for integral hinges and would require a separate hinge to be used. The hinge is in two parts—one part is attached to the outer periphery of each of the cover elements; the second part is attached to the container body. The hinge includes a container body hinge portion extending laterally from each of two opposite sides of the container body near the open end of the container. The cover element hinge portion extends laterally from the outer periphery of each of the cover elements. One of the cover elements is positioned with its hinge portion adjacent one of the container body hinge portions and the other cover element is positioned with its hinge portion adjacent the other container body hinge portion, on the opposite side of the container. Thus, each of the cover elements is individually pivotally interconnected to the container body.

In the preferred embodiment, each of the container body hinge portions and each of the cover element hinge portions comprises a pair of transversely spaced, parallel, laterally extending flanges having aligned apertures therethrough. A hinge rod passes through the aligned apertures and pivotally couples the cover elements to the container body. A transverse web interconnects the distal ends of the flanges. The flanges of the cover element hinge portions are longer and farther apart than the flanges of the container body hinge portions so that the container body hinge portion fits within the cover element hinge portion.

In the preferred embodiment, each of the container body hinge portions further comprises a continuous sleeve extending between the transversely spaced, parallel, laterally extending flanges of the container body hinge portion. The hinge rod passes through the sleeve and is secured therein by conventional means.

In the preferred embodiment, the container body, including a bottom and sidewall, and the container body hinge portions comprise an integrally molded structure. Each of the cover elements and its cover element hinge portion also comprise a separate integrally molded structure. Preferrably, the container body, the lid, and the hinges are rotationally molded of a cross-linked high density polyolefin.

In the preferred embodiment, there are at least two transversely spaced hinge portions on each of the cover elements and at least two transversely spaced hinge portions on each of two opposite sides of the container body. A hinge rod passes through each of the transversely spaced hinge portions and is exposed in the region between the transversely spaced hinge portions so that it can be grasped and function as a handle for manipulating the container. Each of the cover element hinge portions may further comprise a top web covering the space between the flanges of the cover element hinge portion. The top web is connected to the cover element, the flanges of the cover element, and the transverse web of the cover element hinge portion.

The instant invention provides that on the male portion of the hinge, i.e., the container body section, the holes through which the hinge rod passes are cast in during the molding operation of the container body. The "holes" are formed into a sleeve connecting the two lateral walls of the hinge area together. The sleeve not only eliminates the stress concentration on the hinge pin caused by prior art designs by dramatically increasing the bearing area for the hinge pin, but it also tends to tie the two sides of the hinge together adding rigidity to that hinge portion.

On the female portion of the hinge, i.e., that portion which is on the cover element, it is not possible to employ a sleeve, since the female portion must slide over the male portion. In the female hinge portion, a hole is cast in during the rotomold operation, leaving a slight nipple or projection on the inner wall which serves to create a thicker section, thereby reducing the bearing loads. Since the "holes" are cast in during the molding operation, there are no stress concentration points in either the male or female hinge portion usually associated with boring.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

DESCRIPTION OF A PREFERRED EMBODIMENT

The following description of a preferred embodiment of the invention relates to a large, round rotationally molded container on the order of 300 gallons in size. It is to be understood, however, that the principles of the invention are applicable to containers of any practical size and shape, and made by other methods.

Figure 2:
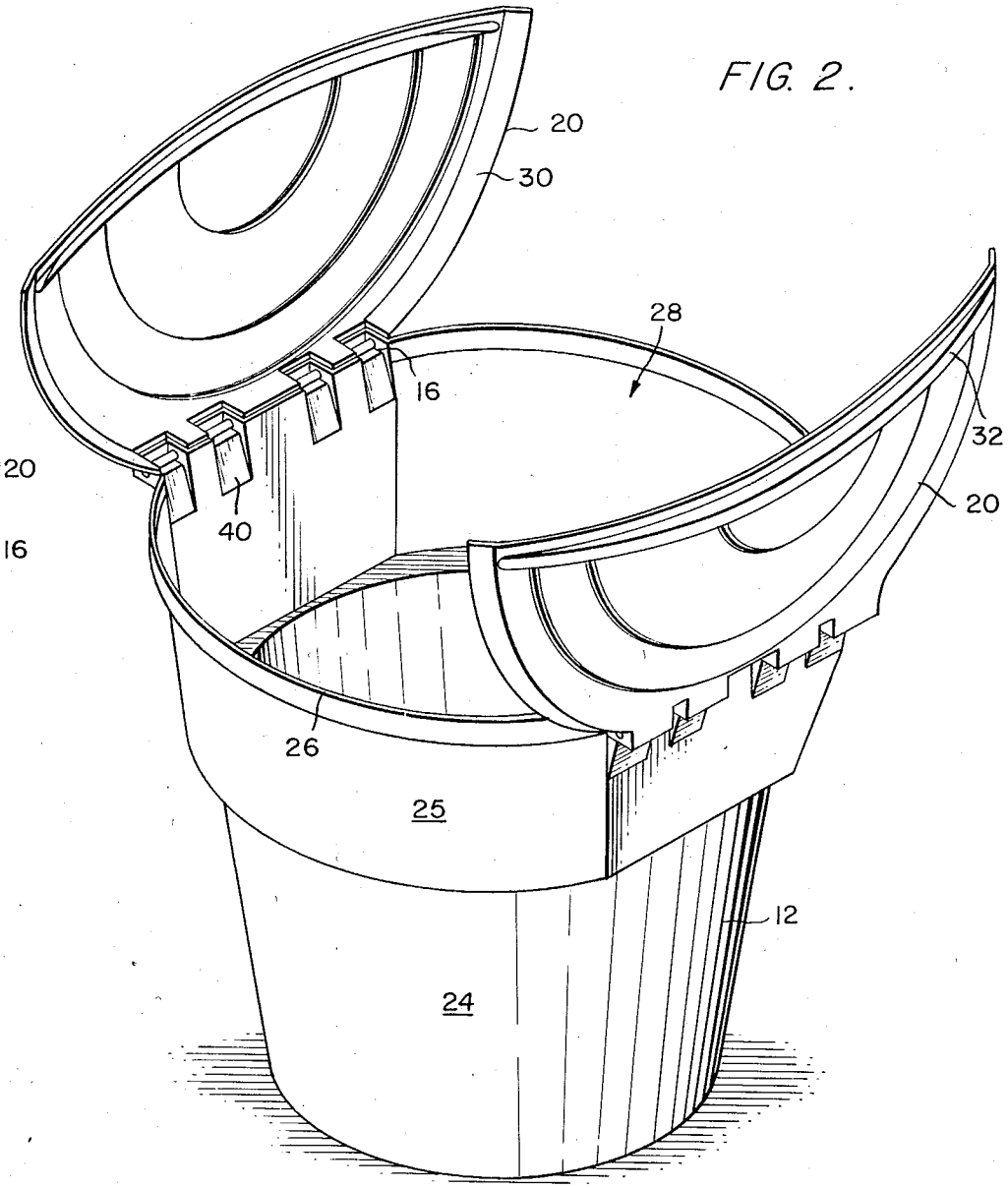
FIG. 2 is a perspective view of the container of the present invention with the cover elements in the open position.
Figure 1:
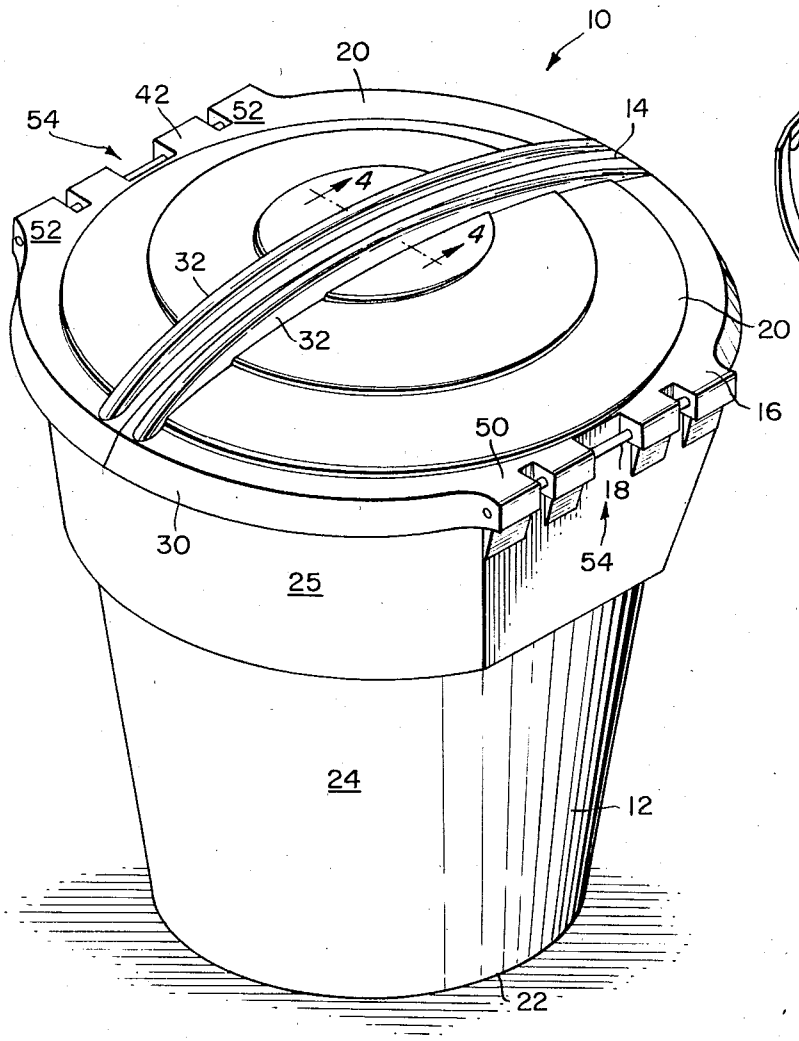
FIG. 1 is a perspective view of the container of the present invention with the cover elements in the closed position.

Referring to FIGS. 1 and 2, a molded refuse container 10 comprises a molded container body 12 and a molded lid 14 which is pivotally coupled to the container body 12 by hinges 16. A hinge rod 18 extends through the hinges 16 to pivotally couple the container body 12 and the lid 14. Lid 14 is formed of two, identical, overlapping cover elements 20.

Container body 12 comprises a bottom 22 and a curved upstanding sidewall 24 having an enlarged upper portion 25. Sidewall 24 is joined to bottom 22 at the lower edge of body 12. The upper edge 26 of sidewall 24 defines an opening 28 into the hollow interior of container body 12. As shown in FIG. 1, cover elements 20 are adapted to overlie and completely close opening 28.

Figure 4:
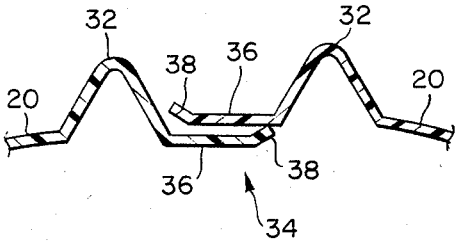
FIG. 4 is a sectional view taken along line 4—4 of FIG. 1.

Hinge 16 pivotally interconnects the outer periphery of each of the cover elements 20 to opposite sides of sidewall 24. Each of the cover elements 20 extends from hinge 16 to a position beyond the center line of the container body 12 so that, when closed, one of the cover elements will overlap the other cover element, as shown more particularly in FIG. 4.

An integrally molded depending peripheral skirt 30 is connected to cover elements 20 and surrounds the upper portion of sidewall 24 when the cover elements 20 are closed.

Figure 3:
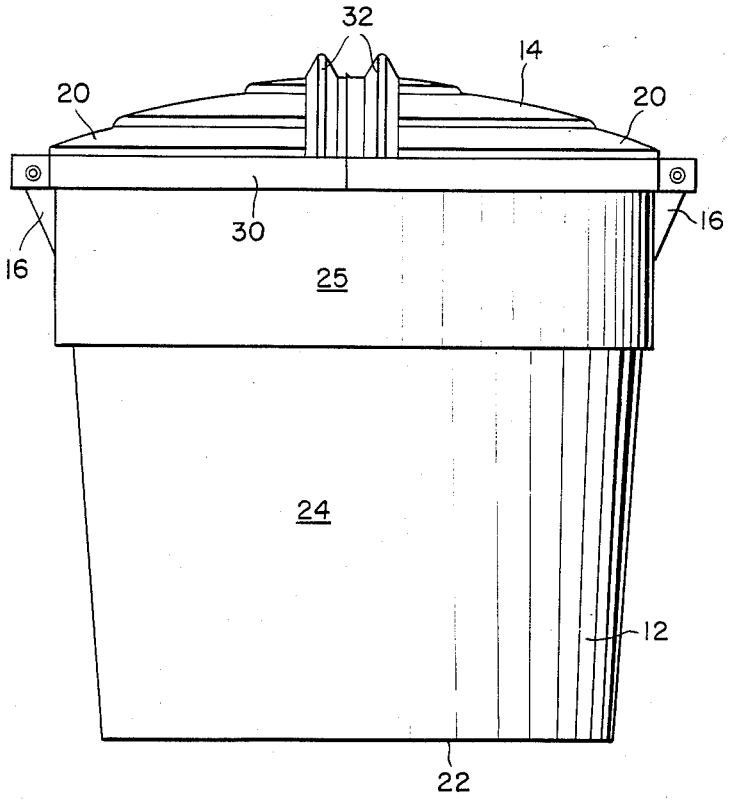
FIG. 3 is a front elevational view of the container of the present invention.

As shown in FIG. 3, lid 14 is dome-shaped and includes barriers or ribs 32. Each of the cover elements 20 has a rib 32 adjacent the overlapping portion 34 of the cover elements, shown in FIG. 4. Each of the cover elements also includes a channel 36 formed on the inner edge of each of the cover elements 20. Channel 36 includes an upturned flange 38 so that channel 36 can function as a "rain gutter" and direct water away from the opening 28.

Figure 5:
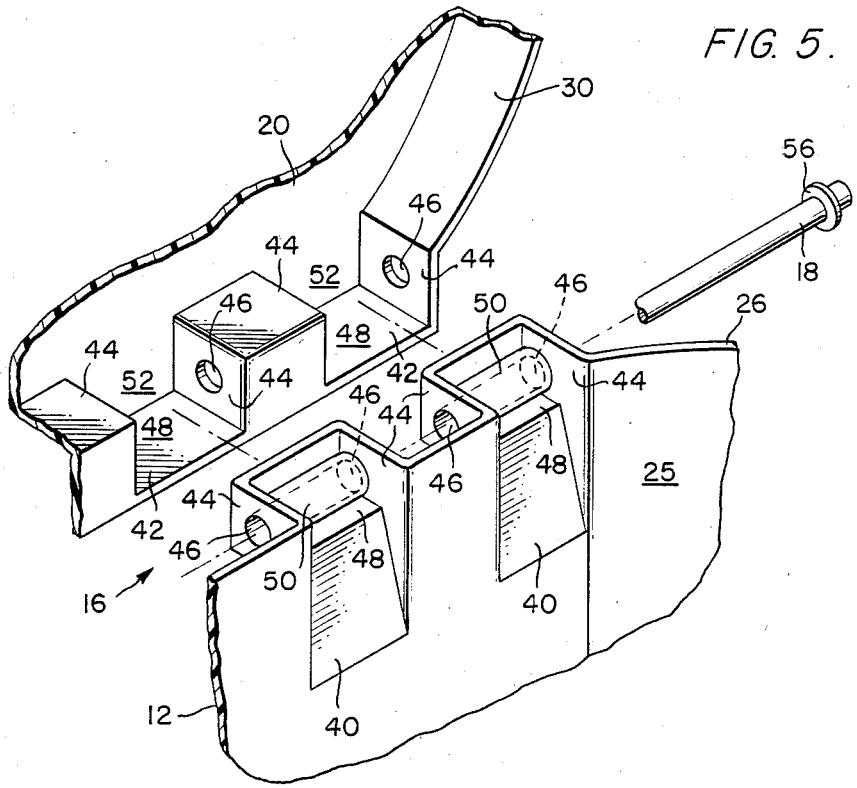
FIG. 5 is an exploded perspective view of the hing means of the present invention.

Hinge 16 comprises two parts: one part is on the container body 12; and the second part is on each of the cover elements 20, as shown more clearly in FIG. 5. The container body hinge portion 40 extends laterally from each of two opposite sides of container body 12 near the upper edge 26 of sidewall 24. Hinge 16 also includes a cover element hinge portion 42 extending laterally from the outer periphery of each of cover elements 20. Each of the container body hinge portions 40 and each of the cover element hinge portions 42 comprises a pair of transversely spaced, parallel, laterally extending flanges 44 having aligned apertures 46 therethrough. A hinge rod 18 passes through apertures 46 and pivotally couples each of cover elements 20 to opposite sides of container body 12 as shown in FIGS. 1 and 2. A transverse web 48 interconnects the distal ends of flanges 44. The flanges of cover element hinge portion 42 are longer and farther apart than the flanges of container body hinge portion 40 so that the container body hinge portion 40 fits within cover element hinge portion 42.

In the preferred embodiment, a continuous sleeve 50, shown in FIG. 5, extends between the aligned apertures 46 of flanges 44 of the container body hinge portion 40. Hinge rod 18 passes through sleeve 50 to pivotally couple the cover element to the container body 12.

In the preferred embodiment, bottom 22, sidewall 24, and the container body hinge portions 40 comprises an integrally molded structure. Additionally, each of the cover elements 20 and the cover element hinge portions 42 thereon comprise a separate integrally molded structure. Preferably, the container body, the cover elements and all of the hinge portions are rotationally molded of a cross-linked, high density polyolefin, although it will be appreciated that other materials and fabrication methods may be used.

Figure 6:
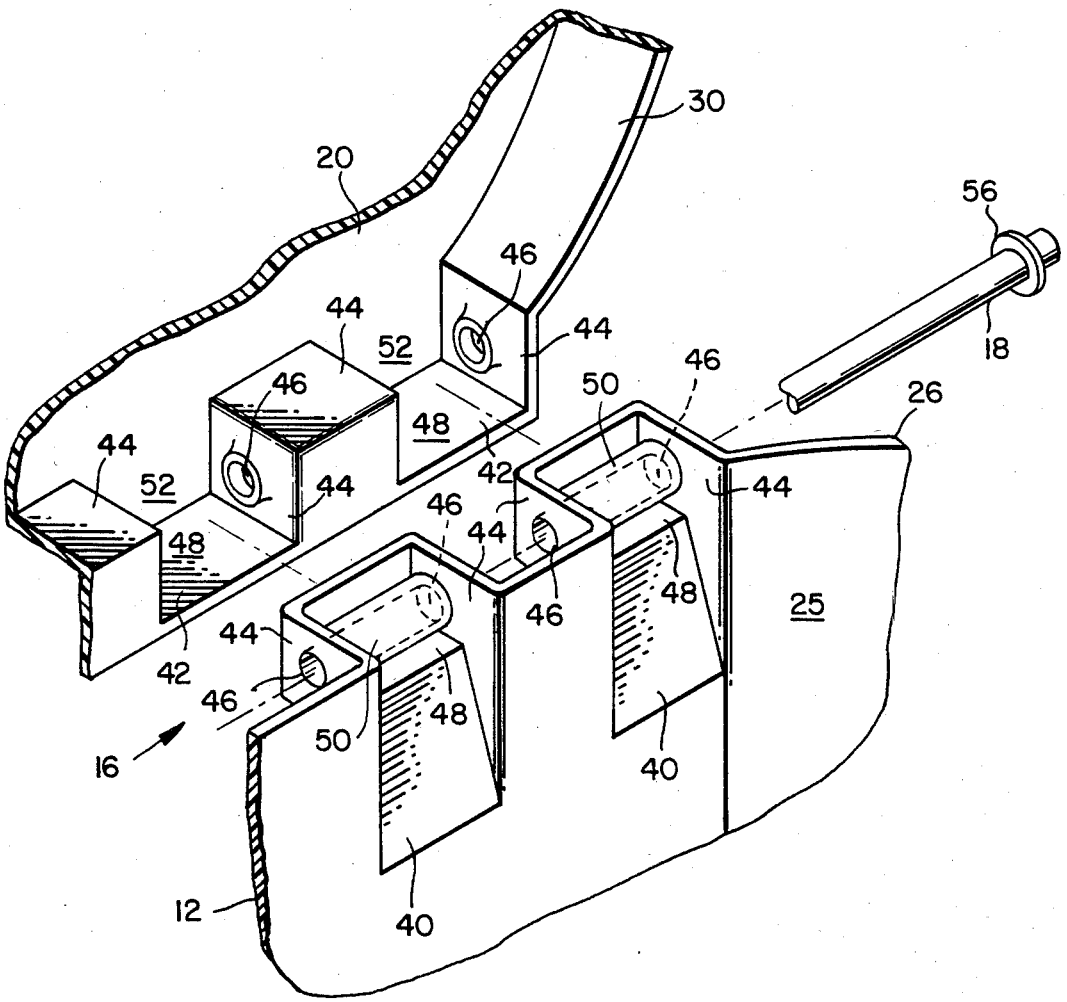

Apertures 46 in flanges 44 of cover element hinge portion 42 may include a slight inward projection or nipple 46, as illustrated in FIG. 6, towards the opposite flange so that the bearing area of the aperture is increased thus reducing the bearing load on the hinge rod 18.

Cover element hinge portion 42 may further include a top web covering the space between the flanges 44 of the cover element hinge portion. The top web 52 is connected to the cover element 20, to the flanges 44, and to the transverse web 48 of the cover element hinge portion 42.

Cover elements 20 may be designed so that they open less than 90° and therefore will always close automatically by their own weight. Alternatively, they may be designed so that they will open slightly more than 90° so that the user can open the cover and it will stay open while refuse is put into the container. The amount of overcenter action (i.e., movement beyond 90°) is slight, however, so that when the automatic equipment returns the container to curbside the impact is sufficient to cause the cover to automatically close.

In the preferred embodiment, more than one hinge portion is used on each of the cover elements and on each side of the container body 12. As shown in FIGS. 1 and 2, preferably four transversely spaced hinged portions 16 will be provided on each of the cover elements 20 and on each side of the container body 12. Hinge rod 18 passes through the aligned apertures 46, through sleeve 50 of each hinge portion and is exposed in the region between the adjacent transversely spaced hinge portions.

As shown in FIG. 1, the spacing between adjacent hinge portions is not uniform. The space between the middle two hinge portions is larger than the space between the other hinge portions so that space for a handgrip 54 is formed and the hinge rod 18 can be grasped and function as a handle for manipulating the container.

Hinge rod 18 is retained in hinges 16 by press on cap nuts 56 or any other means conventional in the art.

Although a particular preferred embodiment has been described, it will be obvious that numerous modifications may be made without departing from the true spirit and scope of the invention which is to be limited only by the following claims.

I claim:

1. A large molded plastic container comprising:

a plastic container body having a bottom and an upstanding sidewall joined to said bottom, said bottom and said sidewall defining a container interior, and said sidewall having an upper edge defining an opening into said interior;

a plastic lid, having a plurality of cover elements, adapted to overlie said opening;

independent hinge means freely pivotally interconnecting the outer periphery of each of said cover elements to said sidewall so that each of said cover elements is free to pivot independently of the others to an angle no greater than slightly more than 90 degrees;

each of said cover elements extending a sufficient distance from said hinge means so that when closed the distal ends of said cover elements overlap, said barrier means for preventing water from entering said container body irrespective of which cover element overlies the other; said barrier means comprising: each cover element having adjacent it's inner edge, an upturned flange, a rib, and a channel located between said upturned flange and rib.

2. A container as recited in claim 1 wherein each of said hinge means comprises a plastic container body hinge portion integral with and extending laterally from said container body near the upper edge of said sidewall, and a mating plastic cover element hinge portion integral with and extending laterally from the outer periphery of said cover element;

said mating adjacent hinge portions pivotally interconnected by a hinge rod so that each of said cover elements is individually pivotally interconnected to said container body.

3. A container as recited in claim 2 wherein each of said container body hinge portions and each of said cover element hinge portions comprises a pair of transversely spaced, parallel, laterally extending flanges having aligned apertures therethrough, and a transverse web interconnecting the distal ends of said flanges, the flanges of said cover element hinge portion being longer and farther apart than the flanges of said container body hinge portion so that said container body hinge portion fits within said cover element hinge portion.

4. A container as recited in claim 3 wherein each of said container body hinge portions further comprises an integral sleeve extending between the aligned apertures of said flanges of said container body hinge portions, and said hinge rod passes through said sleeve.

5. A container as recited in claim 4 further comprising at least two transversely spaced hinge portions on each of said cover elements, and at least two corresponding transversely spaced hinge portions on said container body, said hinge rod passing through each of said transversely spaced hinge portions and said hinge rod being exposed in the region between said transversely spaced hinge portions so that said hinge rod can be grasped and function as a handle for manipulating the container.

6. A container as recited in claim 5 wherein each of said cover element hinge portions further comprises a top web covering the space between the flanges of said cover element hinge portion, said top web being connected to the cover element of said lid and to the flanges and to the transverse web of said cover element hinge portion.

7. A container as recited in claim 6 wherein said cover element hinge portions further comprise sleeve-like projections on each of said flanges of said cover element hinge portion extending from the apertures therein, said projections directed inwardly toward the opposite flange so that the bearing area of said hinge rod is increased thus reducing the bearing load.

8. A container as recited in claim 5 wherein said container body, said lid, and said hinge means are rotationally molded of a cross-linked, high density polyolefin.

9. A container as recited in claim 1, wherein said container body, said lid, and said hinge means are rotationally molded of a cross-linked, high density polyolefin.

10. A large molded plastic container comprising:

a plastic container body having a bottom and an upstanding sidewall joined to said bottom, said bottom and said sidewall defining a container interior, and said sidewall having an upper edge defining an opening into said interior;

two identical, overlapping plastic cover elements adapted to overlie said opening;

one of said cover elements pivotally interconnected to one side of the upper edge of said sidewall and the other of said cover elements pivotally interconnected to the opposite side of the upper edge of said sidewall so that when closed one of said cover elements overlaps the other of said cover elements;

the outer surface of each of said cover elements being convex and the inner surface of each of said cover elements being concave;

barrier means for preventing water from entering said container body irrespective of which cover element overlies the other; said barrier means comprising: each cover element having adjacent it's inner edge, an upturned flange, a rib, and a channel located between said upturned flange and rib, hinge means for pivotally interconnecting the outer periphery of each of said cover elements to said sidewall;

said hinge means comprising a hinge having a container body hinge portion integral with and extending laterally from said container body near the upper edge of said sidewall, and a cover element hinge portion integral with and extending laterally from the outer periphery of each of said cover elements, said cover element hinge portion positioned adjacent said container body hinge portion and pivotally connected thereto so that each of said cover elements is individually pivotally interconnected to said container body and is free to pivot to an angle no greater than slightly more than 90 degrees;

said container body hinge portion and said cover element hinge portion further comprising a pair of transversely spaced, parallel, laterally extending flanges having aligned apertures through which a hinge rod passes, and a transverse web interconnecting the distal ends of said flanges, the flanges of said cover element hinge portion being longer than and farther apart than the flanges of said container body hinge portion so that said container body hinge portion fits within said cover element hinge portion; and said container body hinge portion further comprising an integral sleeve extending between said flanges of said container body hinge portion, said hinge rod passing through said sleeve.

11. A container as recited in claim 10 further comprising at least two transversely spaced hinges, said hinge rod passing through each of said transversely spaced hinges and said hinge rod being exposed in the region between said transversely spaced hinges so that it can be grasped and function as a handle for manipulating the container.

12. A container as recited in claim 10 wherein said container body, said lid and said hinge means are rotationally molded of a cross-linked, high density polyolefin.

* * * * *